US008691739B2

(12) United States Patent
Yokoyama et al.

(10) Patent No.: US 8,691,739 B2
(45) Date of Patent: Apr. 8, 2014

(54) LUBRICATING OIL COMPOSITION

(75) Inventors: Yasuharu Yokoyama, Saitama-ken (JP); Miyoshi Marumo, Saitama-ken (JP); Satoshi Ogano, Kanagawa-ken (JP)

(73) Assignee: Exxonmobil Research and Engineering Company, Annandale, NJ (US)

( * ) Notice: Subject to any disclaimer, the term of this patent is extended or adjusted under 35 U.S.C. 154(b) by 1060 days.

(21) Appl. No.: 11/495,371

(22) Filed: Jul. 28, 2006

(65) Prior Publication Data

US 2007/0032392 A1 Feb. 8, 2007

(30) Foreign Application Priority Data

Aug. 5, 2005 (JP) ..... 2005-228448

(51) Int. Cl.
*C10M 145/14* (2006.01)

(52) U.S. Cl.
USPC ..... 508/469

(58) Field of Classification Search
USPC ..... 508/368, 369, 379, 421, 431–445, 469
See application file for complete search history.

(56) References Cited

U.S. PATENT DOCUMENTS

| | | | | |
|---|---|---|---|---|
| 4,533,482 | A | 8/1985 | Bollinger | |
| 5,372,703 | A * | 12/1994 | Kamiya et al. | 208/58 |
| 5,723,417 | A * | 3/1998 | Kitahara et al. | 508/455 |
| 5,780,399 | A * | 7/1998 | Ishikawa et al. | 508/452 |
| 2002/0002120 | A1* | 1/2002 | Gahagan | 508/396 |

FOREIGN PATENT DOCUMENTS

| | | | |
|---|---|---|---|
| EP | 0621293 | A1 | 4/1994 |
| EP | 1111028 | A1 | 6/2001 |
| JP | 1994313183 | A | 11/1994 |
| JP | 1994336592 | A | 12/1994 |
| JP | 2001181664 | A | 7/2001 |
| JP | 200212884 | A | 1/2002 |

OTHER PUBLICATIONS

T. Kitayama, et al., "NMR Spectroscopy of Polymers", 2004, Springer, pp. 95-104.

* cited by examiner

*Primary Examiner* — Taiwo Oladapo
(74) *Attorney, Agent, or Firm* — Robert A. Migliorini

(57) ABSTRACT

To provide a fuel-efficient lubricating oil composition, particularly suitable for internal combustion engines, which has a reduced shear viscosity in an intermediate temperature range from 80 to 100° C., an effective temperature range for reducing fuel consumption.

The present invention provides a lubricating oil composition comprising a base oil incorporated with a viscosity index improver, wherein the viscosity index improver has a peak area at a chemical shift between 3.4 and 3.7 ppm in a spectral pattern observed by nuclear magnetic resonance analysis ($^1$H-NMR) accounts for 5% or more of the total peak area.

14 Claims, No Drawings

LUBRICATING OIL COMPOSITION

This application relates and claims priority to Japanese Patent Application No. JP 228448/2005 filed Aug. 5, 2005.

FIELD OF THE INVENTION

The present invention relates to a lubricating oil composition, more specifically a lubricating oil composition which can efficiently reduce fuel consumption, particularly suitable for internal combustion engines.

BACKGROUND

Recently, environment preservation measures, beginning with measures against global warming, are becoming unavoidable issues to be promoted for advanced societies. As part of these measures, environmentally friendly lubricating oils are required to satisfy severer conditions. These lubricating oils, in particular those for vehicles, are required to more efficiently reduce fuel consumption in order to abate exhaust carbon dioxide emissions.

Under these situations, a variety of lubricating oil compositions have been proposed to develop fuel-efficient lubricating oils. Many of these compositions are incorporated with various friction reducing agents, e.g., those of molybdenum compounds ("Mo compounds"). They are intended to reduce fuel consumption by reducing friction at slide members. For example, Patent Document 1 (JP-A 6-313183) applied by the inventors of the present invention discloses that friction can be further reduced by incorporating a Mo compound, e.g., molybdenum dithiocarbamate (MODTC) or molybdenum dithiophosphate (MoDTP) in a base oil having specific properties. Patent Document 2 (JP-A 6-336592) discloses that a combination of MoDTC and a specific additive reduce friction still more efficiently.

Friction reducing agents, e.g., those containing a varying Mo compound or the like, exhibit their functions/effects in mixed to boundary lubrication conditions. However, fluid lubrication is predominant in some lubricated members in vehicles. For these members, reducing lubricating oil viscosity is effective for reducing fuel consumption, in particular under high share rates. Effective temperature for fuel saving is in a range of about 80 to 100° C.

However, lubricating oil viscosity decreases as temperature increases. Therefore, a lubricating oil having an excessively low viscosity at 80 to 100° C. will cause troubles related to wear resistance at high temperature, because of broken oil film. As a result, the viscosity standards under high temperature/high shear rate conditions at 150° C. (HTHS150° C. viscosity) are set down for engine oil quality management. According to the viscosity grade standards SAEJ300, SAE20 oil as the lowest viscosity grade is required to have an HTHS150° C. viscosity of 2.6 mPa·s or more. In other words, the HTHS150° C. viscosity standards provide restrictions on conventional techniques to reduce shear viscosity in an intermediate temperature range of 80 to 100° C.

It is essential for a fuel-efficient lubricating oil composition to keep viscosity at a given level under high temperature/high shear rate conditions for securing wear resistance characteristics and, at the same time, to reduce shear viscosity in an intermediate temperature range from 80 to 100° C., an effective temperature range for reducing fuel consumption.

Techniques of prior art are reviewed from the above viewpoint. For example, Patent Document 3 (JP-A 2001-181664) proposes an engine oil having fuel-efficient and low-viscosity characteristics, comprising a base oil incorporated with a viscosity index improver of polymethacrylate, where the base oil has specified properties of viscosity index, aromatic content and so forth. However, it merely presents compositional relationships defining lack of fuel-efficient or low-viscosity characteristics when the base oil fails to satisfy specified properties, composition viscosity deviates from a specified range, or a viscosity index improver of olefin copolymer is used. It is silent on control of shear viscosity in an intermediate temperature range from 80 to 100° C., although discussing HTHS150° C. viscosity in the preferred embodiments. Therefore, there is room for further reduction of fuel consumption. Patent Document 4 (JP-A 2002-12884) discloses a base oil and 6 species of additives for reducing fuel consumption while satisfying cleanness and wear preventing characteristics. However, it merely presents compositional relationships defining lack of one of the above characteristics when a component or its content deviates from a specified range. It is silent on a fuel reduction effect brought by controlling shear viscosity in a range from 80 to 100° C. while keeping a viscosity under high temperature/high shear rate conditions.

As described above, the prior art techniques have neither disclosed nor suggested a fuel-efficient lubricating oil composition which has a reduced shear viscosity in an intermediate temperature range from 80 to 100° C. to reduce fuel consumption while keeping a viscosity at a given level under high temperature/high shear rate conditions.

DESCRIPTION

In one embodiment, it is an object of the present invention to provide a fuel-efficient lubricating oil composition which has peculiar shear viscosity characteristics of reduced shear viscosity in an intermediate temperature range from 80 to 100° C. to reduce fuel consumption while keeping a viscosity at a given level under high temperature/high shear rate conditions, and has an excellent fuel-saving effect, in consideration of the above development situations. In another embodiment an object of the present invention is to provide a lubricating oil composition which can bring a fuel-saving effect under all lubrication conditions by incorporating one or more additives for lubricating oil, e.g., friction modifier.

The inventors of the present invention have found, after having extensively studied to solve the above problems, that a lubricating oil composition can have a greatly reduced shear viscosity in an intermediate temperature range from 80 to 100° C., an effective temperature range for reducing fuel consumption, to reduce fuel consumption while keeping a viscosity at a given level under high temperature/high shear rate conditions, when it is incorporated with a viscosity index improver having a characteristic that a peak area at a specific chemical shift in a spectral pattern observed by nuclear magnetic resonance analysis ($^1$H-NMR) accounts for a specific proportion of the total peak area, achieving the present invention.

The present invention provides a lubricating oil composition comprising a base oil incorporated with a viscosity index improver, wherein the viscosity index improver has a characteristic that a peak area at a chemical shift between 3.4 and 3.7 ppm in a spectral pattern observed by nuclear magnetic resonance analysis ($^1$H-NMR) accounts for 5% or more of the total peak area (the proportion may be hereinafter referred to as "peak area proportion at a chemical shift between 3.4 and 3.7 ppm in a spectral pattern observed by $^1$H-NMR analysis).

The preferred embodiments of the present invention include at least (1) to (7) items, described below:

(1) The lubricating oil composition described above, wherein the base oil has an aniline point of 100° C. or higher.

(2) The lubricating oil composition described above, wherein the viscosity index improver has a peak area proportion of 7% or more at a chemical shift between 3.4 and 3.7 ppm in a spectral pattern observed by $^1$H-NMR analysis.

(3) The lubricating oil composition described above, wherein the viscosity index improver is of a polymethacrylate-based one.

(4) The lubricating oil composition described above which has a viscosity of 2.6 mPa·s or more under high temperature/high shear rate conditions, and a shear viscosity at 100° C. lower at least by 0.3 mPa·s than that of a composition incorporated with a viscosity index improver having a peak area proportion below 5% at a chemical shift between 3.4 and 3.7 ppm in a spectral pattern observed by $^1$H-NMR analysis.

(5) The lubricating oil composition described above which is incorporated with at least one species of molybdenum-based friction modifier containing a Mo compound selected from the group consisting of molybdenum dithiocarbamate and molybdenum dithiophosphate.

(6) The lubricating oil composition described above, wherein the friction modifier is of at least one species of ashless one containing a compound selected from the group consisting of fatty acid ester, fatty acid amide and amine compounds.

(7) The lubricating oil composition described above which is incorporated with at least one species of additive selected from the group consisting of ashless dispersant, metallic detergent, wear inhibitor and oxidation inhibitor, in addition to the above-described molybdenum-based and/or ashless friction modifiers.

The lubricating oil composition of the present invention, having the above-described constitution, can have a greatly reduced shear viscosity in an intermediate temperature range from 80 to 100° C., an effective temperature range for reducing fuel consumption, while keeping seizure and wear preventing characteristics under high temperature/high shear rate conditions. More specifically, the lubricating oil compositions prepared in EXAMPLES, later described, can have a shear viscosity at 100° C. reduced to a level lower at least by 0.3 mPa·s than that of a composition incorporated with a viscosity index improver having a peak area proportion below 5% at a chemical shift between 3.4 and 3.7 ppm in a spectral pattern observed by $^1$H-NMR analysis, even when it has a viscosity of 2.6 mPa·s or more under high temperature/high shear rate conditions to keep wear resistance characteristics.

As a result, the lubricating oil composition brings a significantly improved fuel-saving effect at lubricated areas in vehicles and the like, where fluid lubrication predominates, by reducing its viscosity.

The present invention is described in more detail:

The base oil for the lubricating oil composition of the present invention is not limited, so long as it is commonly used and can be used as a lubricating oil base oil. More specifically, the base oils useful for the present invention include mineral base oils, GTL (gas-to-liquid)-based oil, synthetic oil and a mixture thereof. It can be selected from the various ones, described below, to have desired viscosity and other characteristics, viewed from securing fuel-saving effect. These base oils may be used either individually or in adequate combination. More specifically, the preferable one for the present invention has a kinematic viscosity controlled at 2 to 10 mm$^2$/s at 100° C., more preferably 3 to 8 mm$^2$/s, although varying depending on specific purposes. A base oil having a kinematic viscosity below 2 mm$^2$/s at 100° C. may have an insufficient viscosity under high temperature/high shear rate conditions to cause wear-related problems because of broken oil film. On the other hand, a base oil having a kinematic viscosity above 10 mm$^2$/s at 100° C. may have deteriorated viscosity characteristics at low temperature and also have deteriorated energy-saving effect because of increased fluid resistance.

Aniline point, by which the base oil for the lubricating oil composition of the present invention is specified, is preferably as high as possible so long as the base oil can dissolve a viscosity index improver as a constituent component of the composition. More specifically, it is preferably 100° C. or higher, more preferably 103° C. or higher, to secure a synergistic effect with a viscosity index improver. The upper limit is not limited. However, it should be noted that a base oil having an aniline point above 130° C. may have problems related to solubility of viscosity index improver. Aniline point is determined in accordance with JIS K-2256.

Viscosity index of the base oil is not limited. It is preferably 100 or more, more preferably 110 or more to secure excellent viscosity characteristics over a wide temperature range.

Evaporation loss is one of the basic properties for a base oil. It is not limited for the present invention. However, it is preferably 20% by mass or less in terms of NOACK volatility, more preferably 16% by mass. NOACK volatility above 20% by mass is not desirable. A lubricating oil composition comprising such a base oil may be consumed excessively, when used as a lubricating oil for internal combustion engines, to increase viscosity of the oil in a crank case, with the result that the advantage of the present invention, i.e., reduced shear viscosity in an intermediate temperature range of 80 to 100° C., may not be secured. NOACK volatility is determined in accordance with ASTM D-5800.

The mineral and synthetic base oils for the lubricating oil composition of the present invention are described specifically.

The mineral base oils useful for the present invention include vacuum distillates of paraffinic and/or naphthenic crudes as lubricating oil fractions treated by one or more processes selected from solvent refining, hydrocracking, hydrotreating, hydrorefining, solvent dewaxing, catalytic dewaxing, clay treatment and so forth; deasphalted oils produced by solvent deasphalting and treated by one or more of the above processes; mineral oils produced by wax isomerization; and a mixture thereof. The solvent refining process uses an aromatic extractant, e.g., phenol, furfural, or N-methyl-2-pyrrolidone. The solvent dewaxing process uses a solvent, e.g., liquefied propane or methylethylketone (MEK)/toluene. The catalytic dewaxing process uses a dewaxing catalyst, e.g., shape-selective zeolite.

GTL-based base oils include lubricating oil fractions separated from liquid products produced from natural gas or the like as a starting material, and lubricating oil fractions produced by hydrocracking of produced wax. Lubricating oil fractions separated from liquid products produced by an asphalt-to-liquid (ATL) process which treats heavy residue fractions, e.g., asphalt, are also useful as the base oils for the present invention.

The above-described mineral base oils are provided as light neutral, intermediate neutral or heavy neutral oils, bright stocks, or the like depending on their viscosity level.

On the other hand, synthetic base oils may be selected from hydrocarbon-based ones, including the hydrocarbon-based polymers and copolymers listed below, in such a way to satisfy viscosity characteristics of the lubricating oil composition of the present invention. Poly-α-olefin oligomers, e.g., poly(1-hexene), poly(1-octene), poly(1-decene) and a mixture thereof; polybutenes; ethylene-alkylene copolymers; alkyl benzenes, e.g., dodecylbenzene, di(2-ethylhexyl)benzene and dinonylbenzene; polyphenyls, e.g., biphenyl and alkylated polyphenyl; alkylated diphenyl ethers, alkylated diphenyl sulfide and a derivative thereof; esters of a dibasic acid (e.g., phthalic, succinic, alkylsuccinic, alkenylsuccinic, maleic, azelaic, suberic, sebacic or fumaric acid) with pentaerythritol or tripentaerythritol; and polyoxyalkylene glycol, polyoxyalkylene glycol ester, polyoxyalkylene glycol ether, phosphoric acid ester and silicone oil.

The viscosity index improver as a constituent component of the lubricating oil composition of the present invention has a peak area at a chemical shift between 3.4 and 3.7 ppm in a spectral pattern observed by nuclear magnetic resonance analysis ($^1$H-NMR) accounting for 5% or more of the total peak area. When the viscosity index improver was incorporated with a diluent oil, the $^1$H-NMR analysis was carried out with a sample polymer treated beforehand to remove the diluent oil by dialysis with a rubber membrane.

The total peak area in the spectral pattern means a total of peak areas extending over a chemical shift range from 0 to 10 ppm, and represents a total number of hydrogen atoms.

The peak at a chemical shift between 3.4 and 3.7 ppm in a $^1$H-NMR spectral pattern of a polymethacrylate-based viscosity index improver is considered to be due to the hydrogen atom bound to the carbon atom adjacent to an atom of high electrical negativity, based on the principle of nuclear magnetic resonance analysis, although not fully substantiated.

It is therefore considered that a peak area at a chemical shift between 3.4 and 3.7 ppm accounting for 5% or more of the total peak area means that the above hydrogen atoms account for 5% or more of the total hydrogen atoms. The lubricating oil composition incorporated with the viscosity index improver of the above characteristic has a peculiar effect of greatly reduced shear viscosity in an intermediate temperature range of 80 to 100° C., even when its viscosity under high temperature/high shear rate conditions is kept at a constant level. Therefore, the viscosity index improver is adopted for the present invention.

By contrast, a viscosity index improver as a constituent component of a lubricating oil composition prepared in COMPARATIVE EXAMPLE has a peak area at a $^1$H-NMR chemical shift between 3.4 and 3.7 ppm much lower than 5% of the total peak area. It is demonstrated that such a composition fails to sufficiently reduce shear viscosity in the intermediate temperature range.

As discussed above, the viscosity index improver as a constituent component of the lubricating oil composition has a peak area at a $^1$H-NMR chemical shift between 3.4 and 3.7 ppm accounting for 5% or more of the total peak area, preferably 7% or more, more preferably 8% or more. On the other hand, a viscosity index improver having a peak area less than 5% of the total peak area fails to sufficiently reduce shear viscosity in the intermediate temperature range, when a viscosity under high temperature/high shear rate conditions is kept at a given level, e.g., 2.6 mPa·s, and hence cannot achieve the object of the present invention.

The viscosity index improver as a constituent component of the lubricating oil composition has a weight-average molecular weight of 150,000 or more, preferably 250,000 or more, where the weight-average molecular weight is as polystyrene, determined by gel permeation chromatography (GPC). A viscosity index improver having a lower weight-average molecular weight may be insufficient in thickening effect and hence economically disadvantageous, because a larger quantity is needed to secure a certain viscosity under high-temperature/high-shear rate conditions at 150° C. The upper limit of the weight-average molecular weight is not limited. However, a viscosity index improver having a weight-average molecular weight above 1,000,000 may have deteriorated stability to shear stress to cause unexpected wear, because of decreased viscosity resulting from decreased molecular weight under a shear stress, even when the lubricating oil composition initially has a required viscosity under high-temperature/high-shear rate conditions at 150° C.

The viscosity index improver as a constituent component of the lubricating oil composition of the present invention is not limited so long as it has the specific $^1$H-NMR characteristic. It may be of a compound selected from the group consisting of polymethacrylate (PMA), polyisobutylene, polyalkylstyrene, ethylene/propylene copolymer (olefin copolymer, OCP), styrene/hydrogenated diene copolymer (SDC) and styrene/maleic unhydride ester copolymer, of which polymethacrylate is more preferable. The improver may be of a non-dispersed or dispersed type.

The polymethacrylate-based viscosity index improver of non-dispersed type is of a polymethacrylate polymer, whereas that of dispersed type is of a copolymer with a polar monomer having a nitrogen-containing group in the molecular structure. The polar monomers useful for the present invention include amines, e.g., diethylaminoethyl methacrylate, dimethylaminomethyl methacrylate, dimethylaminoethyl methacrylate and 2-methyl-5-vinyl pyridine; ethylaminoethyl methacrylate; amides, e.g., N-methylpyrrolidone; and imidazole and morpholinoalkylmethacrylate. Other polar monomers free of nitrogen-containing group, e.g., polyalkylene glycol ester and maleic anhydride, may be also used, The viscosity index improver is incorporated at a content to secure a desired viscosity under high-temperature/high-shear rate conditions at 150° C., at 1 to 15% by mass on the whole lubricating oil composition.

The lubricating oil composition of the present invention can be used for various purposes, beginning with internal combustion engines. It may be incorporated with one or more additives optionally selected from the group consisting of ashless dispersant, metallic detergent, oxidation inhibitor, wear inhibitor, friction modifier, sulfur supplying agent, corrosion inhibitor, pour point depressant, extreme-pressure agent, rust inhibitor, metal passivator, antifoaming agent and so forth. In particular, it is preferably incorporated with at least one species of friction modifier to provide the fuel-efficient lubricating oil composition for internal combustion engines.

The effect of the lubricating oil composition incorporated with a specific viscosity index improver for reducing a shear viscosity at 100° C. is realized irrespective of improver species and its content at the same shear viscosity under species and content under high temperature/high shear rate conditions at 150° C. which the composition gives. It can be realized by the lubricating oil composition incorporated with no additive except the viscosity index improver.

The friction modifiers useful for the present invention include organomolybdenum compounds, e.g., molybdenum dithiocarbamate and molybdenum dithiophosphate, fatty acid, higher alcohol, fatty acid ester, oil and fat, amine, polyamide, sulfided ester, phosphoric acid ester, acidic phosphoric acid ester, phosphorous acid ester, amine salt of phosphoric acid ester and so forth.

When incorporated with a friction modifier, the lubricating oil composition can reduce friction in mixed to boundary lubrication conditions, to exhibit fuel-saving effect in all types of lubrication conditions, because it can reduce fluid resistance in fluid lubrication conditions by virtue of the specific viscosity index improver which it contains. The organomolybdenum compound described above is a particularly preferable friction modifier. It is incorporated at 0.01 to 0.2% by mass as molybdenum.

The ashless dispersants useful for the present invention include those based on polybutenyl succinic acid imide, polybutenyl succinic acid amide, benzylamine, succinic acid ester, succinic acid ester-amide and a boron derivative thereof. The ashless dispersant is incorporated normally at 0.05 to 8% by mass.

The metallic detergent may be selected from those containing a sulfonate, phenate, salicylate and carboxylate of calcium, magnesium and sodium or the like. It may be optionally selected from perbasic, basic, neutral salts and so forth of different acid value, of which a detergent containing perbasic calcium salicylate is particularly preferable. The metallic detergent is incorporated normally at 0.05 to 5% by mass.

The oxidation inhibitors which can be used for the present invention include amine-based ones, e.g., alkylated diphenylamine, phenyl-α-naphtylamine and alkylated phenyl-α-naphtylamine; phenol-based ones, e.g., 2,6-di-t-butyl phenol, 4,4'-methylene-bis(2,6-di-t-butyl phenol), 4,4'-methylene-bis(2,6-di-t-butyl phenol), 4,4'-bis(2,6-di-t-butyl phenol), 4,4'-butylidene-bis(3-methyl-6-t-butyl phenol), 4,4'-isopropylidene-bis(4-methyl-6-t-butyl phenol), 2,2'-methylene-bis(4-methyl-6-t-butyl phenol), 2,2'-isobutylidene-bis(4,6-dimethylphenol) and isooctyl-3-(3,5-di-t-butyl-4-hydroxyphenol); sulfur-based ones, e.g., dilauryl-3,3'-thiodipropionate; phosphorus-based ones, e.g., phosphate; molybdenum-based ones; and zinc dialkyl dithiophosphate, of which phenol-based ones, e.g., 4,4'-methylene-bis(2,6-di-t-butyl phenol) are more preferable. The oxidation inhibitor is incorporated normally at 0.05 to 5% by mass.

The wear inhibitors useful for the present invention include those containing phosphorus, e.g., zinc dialkyl dithiophosphate, zinc alkyl thiophosphate and zinc alkyl phosphate. The agent is incorporated normally at 0.02 to 0.12% by mass as phosphorus. The lubricating oil composition is further incorporated with a compound as an auxiliary component for the zinc salt. These compounds include a metallic salt of dithiophosphoric acid other than zinc salt, metallic salt of dithiocarbamic acid, metallic salt of naphthenic acid, metallic salt of fatty acid, boron compound, phosphoric acid ester, phosphorous acid ester and amine salt of phosphoric acid ester. The particularly preferable wear inhibitor is zinc dialkyl dithiophosphate. The agent is incorporated normally at 0.05 to 2.0% by mass. The lubricating oil composition of the present invention, when used for internal combustion engines, is incorporated with the phosphorus-containing agent at 0.12% by mass or less, preferably 0.08% by mass or less as phosphorus in consideration of possible adverse effects of the phosphorus compound on an exhaust gas cleaning-up device.

The sulfur supplying agents useful for the present invention include a metallic salt of dialkyldithiocarbamic acid; ashless type polysulfide having a sulfur atom group with 2 or more sulfur atoms directly bound to each other in the molecular structure, e.g., tetraalkylthiuram disulfide, and disulfide having an alkyl, aryl, alkylaryl or arylalkyl group; thiadiazole having a sulfur-containing substituent; sulfided olefin; sulfided ester; and sulfided fish oil, of which sulfided olefin is particularly preferable. The agent is incorporated normally at 0.02 to 0.3% by mass as sulfur. Sulfur, when excessively present, may cause corrosion-induced wear, and also may deteriorate an exhaust gas cleaning-up device when the lubricating oil composition of the present invention is used for internal combustion engines.

The corrosion inhibitors useful for the present invention include benzotriazole, benzoimidazole, thiadiazole and a derivative thereof, of which thiadiazole is more preferable. The corrosion inhibitor is incorporated preferably at 0.01 to 3% by mass.

The pour point depressants useful for the present invention include ethylene/vinyl acetate copolymer, condensate of chlorinated paraffin and naphthalene, condensate of chlorinated paraffin and phenol, polymethacrylate, polyalkyl styrene and so forth, of which polymethacrylate is more preferable. The pour point depressant is incorporated normally at 0.01 to 3% by mass.

The extreme-pressure additives useful for the present invention commonly include an ashless sulfide, sulfide oil/fat, phosphoric acid ester, phosphorous acid ester, amine salt of phosphoric acid ester. The extreme-pressure agent is incorporated normally at 0 to 3% by mass.

The rust inhibitors useful for the present invention include a fatty acid, alkenylsuccinic acid half ester, fatty acid soap, alkylsulfonate, polyhydric alcohol/fatty acid ester, fatty acid amine, oxidized paraffin and alkylpolyoxyethylene ether. The rust inhibitor is incorporated normally at 0 to 3% by mass.

The metal passivators useful for the present invention include imidazoline, a pyrimidine derivative, thiadiazole, benzotriazole and a derivative thereof, and so forth. The metal passivator is incorporated normally at 0 to 3% by mass.

The defoaming agents useful for the present invention include polydimethyl siloxane, polymethacrylate and a fluorine derivative thereof, perfluoropolyether, and so forth, of which polydimethyl siloxane is more preferable. The defoaming agent is incorporated normally at 10 to 100 ppm by mass.

As described above, the lubricating oil composition of the present invention comprises (1) a base oil incorporated with (2) a viscosity index improver which has a peak area at a chemical shift between 3.4 and 3.7 ppm in a spectral pattern observed by nuclear magnetic resonance analysis ($^1$H-NMR) accounting for 5% or more of the total peak area as the essential components, and is further incorporated with at least one species of additive selected from the other additives, to have peculiar shear viscosity characteristics. It can be used as a fuel-efficient lubricant for various areas including internal combustion engines to begin with, driving systems and other industrial areas in which the shear viscosity characteristics of the present invention can be exhibited.

EXAMPLES

The present invention is described in more detail by EXAMPLES and COMPARATIVE EXAMPLES, which by no means limit the present invention.

The following methods (1) to (5) were used in EXAMPLES and COMPARATIVE EXAMPLES for measuring properties of the lubricating oil compositions and evaluating their characteristics.

(1) Shear viscosity under high temperature/high shear rate conditions: determined by a TBS viscometer at 150° C. and shear rate of $1.0\times10^6$ $s^{-1}$ in accordance with ASTM D-4683.

(2) Shear rate in intermediate temperature range: determined at 100° C. and shear rate of $1.0\times10^6$ s-1 also in accordance with ASTM D-4683.

(3) Kinematic viscosity (KV), determined in accordance with JIS K-2283.

(4) Aniline point: determined in accordance with JIS K-2256.

(5) Nuclear magnetic resonance analysis ($^1$H-NMR)

The analysis was carried out using the following analyzer and measuring conditions.

[1] Analyzer: 400 MHz NMR, GSX-400 (Hitachi Electronics Services)

[2] Measured nucleus: $^1$H

[3] Analysis mode: Non-decoupling

[4] Flip angle: 45 degrees

[5] Waiting time: 5 seconds

[6] Sample rotation speed: 12 Hz

[7] Window processing: Exponential function

Sample pretreatment: 1 mg of sample was dissolved in 131.0 mL of CDC

[9] Peak position of a reference sample: 7.26 ppm (lock solvent)

[10] Number of analysis cycles: 200

The items (6) to (8) describe the base oils, viscosity index improvers and so forth used as the composition components.

(6) Base Oils

A total of three types of mineral base oils, Mineral Base Oils A, B and C, were prepared by mixing solvent-refined, paraffinic mineral base oil (kinematic viscosity: 4.3 mm$^2$/s at 100° C.) and hydrocracked mineral oil (kinematic viscosity: 4.3 mm$^2$/s at 100° C.) in ratios given in the following table.

TABLE A

| | Paraffinic mineral base oil/Hydrocracked mineral oil | Kinematic viscosity at 100° C. (mm$^2$/s) | Aniline point (° C.) |
|---|---|---|---|
| Base Oil A | 95/5 | 4.3 | 102 |
| Base Oil B | 60/40 | 4.3 | 107 |
| Base Oil C | 0/100 | 4.3 | 116 |

(7) Viscosity Index Improvers

A total of 7 species of polymethacrylate-based viscosity index improvers, PMA-1 to PMA-7 given in the following table, were used and analyzed by $^1$H-NMR to determine a proportion of peak area at a chemical shift between 3.4 and 3.7 ppm in a spectral pattern. The analysis of a commercial improver was carried out with a sample polymer treated beforehand to remove a diluent oil by dialysis with a rubber membrane.

TABLE B

PMA-based viscosity index improvers

| Names | Type | Weight-average molecular weight | Proportion of peak area at a chemical shift between 3.4 and 3.7 ppm in a $^1$H-NMR spectral pattern. |
|---|---|---|---|
| PMA-1 | Dispersed | 460,000 | 10.5 |
| PMA-2 | Dispersed | 170,000 | 8.6 |
| PMA-3 | Dispersed | 460,000 | 12.6 |
| PMA-4 | Dispersed | 170,000 | 10.4 |
| PMA-5 | Non-dispersed | 170,000 | 10.3 |
| PMA-6 | Dispersed | 460,000 | 2.1 |
| PMA-7 | Non-dispersed | 370,000 | 0.4 |

(8) Other Additives:

A package of additives including the following additives:

Ashless dispersant: Polybutenyl succinic acid imide

Metallic detergent: Perbasic calcium salicylate, perbasic calcium sulfonate and neutral calcium salicylate Oxidation inhibitor: 4,4'-Methylene-bis(2,6-di-t-butyl phenol)

Wear inhibitor: Zinc dithiophosphate

Friction modifier: Molybdenum dithiocarbamate

Sulfur supplying agent: Sulfided olefin

Corrosion inhibitor: Thiadiazole

Pour point depressant: Polymethacrylate, and

Defoaming agent: Polydimethyl siloxane

Example 1

Base Oil C was incorporated with PMA-1, a dispersed type, polymethacrylate-based viscosity index improver having a peak area proportion of 10.5% at a chemical shift between 3.4 and 3.7 ppm in a $^1$H-NMR spectral pattern, at 5.9% by mass and also with the additive package including other additives at 13.4% by mass, to prepare Sample Composition "a" having an HTHS150° C. viscosity of 2.6 mPa·s and shear viscosity of 5.3 mPa·s at 100° C.

Example 2

Base Oil A was incorporated with PMA-2, a dispersed type, polymethacrylate-based viscosity index improver having a peak area proportion of 8.6% at a chemical shift between 3.4 and 3.7 ppm in a $^1$H-NMR spectral pattern, at 5.6% by mass and also with the additive package including other additives at 13.4% by mass, to prepare Sample Composition "b" having an HTHS150° C. viscosity of 2.6 mPa·s and shear viscosity of 5.7 mPa·s at 100° C.

Example 3

Base Oil C was incorporated with PMA-3, a dispersed type, polymethacrylate-based viscosity index improver having a peak area proportion of 12.6% at a chemical shift between 3.4 and 3.7 ppm in a $^1$H-NMR spectral pattern, at 5.8% by mass and also with the additive package including other additives at 13.4% by mass, to prepare Sample Composition "c" having an HTHS150° C. viscosity of 2.6 mPa·s and shear viscosity of 5.1 mPa·s at 100° C.

Example 4

Base Oil C was incorporated with PMA-4, a dispersed type, polymethacrylate-based viscosity index improver having a peak area proportion of 10.4% at a chemical shift between 3.4 and 3.7 ppm in a $^1$H-NMR spectral pattern, at 6.0% by mass and also with the additive package including other additives at 13.4% by mass, to prepare Sample Composition "d" having an HTHS150° C. viscosity of 2.6 mPa·s and shear viscosity of 5.4 mPa·s at 100° C.

Example 5

Base Oil C was incorporated with PMA-5, a non-dispersed type, polymethacrylate-based viscosity index improver having a peak area proportion of 10.3% at a chemical shift between 3.4 and 3.7 ppm in a $^1$H-NMR spectral pattern, at 6.0% by mass and also with the additive package including other additives at 13.4% by mass, to prepare Sample Composition "e" having an HTHS150° C. viscosity of 2.6 mPa·s and shear viscosity of 5.4 mPa·s at 100° C.

Example 6

Base Oil B was incorporated with PMA-5, a dispersed type, polymethacrylate-based viscosity index improver having a peak area proportion of 10.5% at a chemical shift between 3.4 and 3.7 ppm in a $^1$H-NMR spectral pattern, at 5.2% by mass and also with the additive package including other additives at 13.4% by mass, to prepare Sample Composition "f" having an HTHS150° C. viscosity of 2.6 mPa·s and shear viscosity of 5.4 mPa·s at 100° C.

Comparative Example 1

Base Oil C was incorporated with PMA-6, a dispersed type, polymethacrylate-based viscosity index improver having a peak area proportion of 2.1% at a chemical shift between 3.4 and 3.7 ppm in a $^1$H-NMR spectral pattern, at 5.0% by mass and also with the additive package including other additives at 13.4% by mass, to prepare Sample Composition "aa" having an HTHS150° C. viscosity of 2.6 mPa·s and shear viscosity of 6.0 mPa·s at 100° C.

Comparative Example 2

Base Oil C was incorporated with PMA-7, a non-dispersed type, polymethacrylate-based viscosity index improver having a peak area proportion of 0.4% at a chemical shift between 3.4 and 3.7 ppm in a $^1$H-NMR spectral pattern, at 3.5% by mass and also with the additive package including other additives at 13.4% by mass, to prepare Sample Composition "bb" having an HTHS150° C. viscosity of 2.6 mPa·s and shear viscosity of 6.1 mPa·s at 100° C.

Table 1 summarizes a composition, shear viscosity characteristics and so forth of the sample oil composition prepared in each of EXAMPLES 1 to 6 and COMPARATIVE EXAMPLES 1 to 2.

TABLE 1

| | EXAMPLES | | | | | | COMPARATIVE EXAMPLES | |
|---|---|---|---|---|---|---|---|---|
| | 1 | 2 | 3 | 4 | 5 | 6 | 1 | 2 |
| Sample oils | a | b | c | d | e | f | aa | bb |
| Base oil | C | A | C | C | C | B | C | C |
| Kinematic viscosity at 100° C. (mm$^2$/s) | 4.3 | 4.3 | 4.3 | 4.3 | 4.3 | 4.3 | 4.3 | 4.3 |
| Aniline point (° C.) | 116 | 102 | 116 | 116 | 116 | 107 | 116 | 116 |
| Viscosity index improvers | | | | | | | | |
| PMA-1: Dispersed type, weight-average-molecular weight: 460,000 (% by mass) | 5.9 | — | — | — | — | 5.2 | — | — |
| PMA-2 Dispersed type, weight-average-molecular weight: 170,000 (% by mass) | — | 5.6 | — | — | — | — | — | — |
| PMA-3: Dispersed type, weight-average-molecular weight: 460,000 (% by mass) | — | — | 5.8 | — | — | — | — | — |
| PMA-4: Dispersed type, weight-average-molecular weight: 170,000 (% by mass) | — | — | — | 6.0 | — | — | — | — |
| PMA-5: Non-dispersed type, weight-average-molecular weight: 170,000 (% by mass) | — | — | — | — | 6.0 | — | — | — |
| PMA-6: Dispersed type, weight-average-molecular weight: 460,000 (% by mass) | — | — | — | — | — | — | 5.0 | — |
| PMA-7: Non-dispersed type, weight-average-molecular weight: 370,000 (% by mass) | — | — | — | — | — | — | — | 3.5 |
| Peak area proportion at a chemical shift between 3.4 and 3.7 ppm in a $^1$H-NMRspectral pattern (%) | 10.5 | 8.6 | 12.6 | 10.4 | 10.3 | 10.5 | 2.1 | 0.4 |
| Other additives* (% by mass) | 13.4 | 13.4 | 13.4 | 13.4 | 13.4 | 13.4 | 13.4 | 13.4 |
| Shear viscosity** at 150° C. (mPa · s) | 2.6 | 2.6 | 2.6 | 2.6 | 2.6 | 2.6 | 2.6 | 2.6 |
| Shear viscosity** at 100° C. (mPa · s) | 5.3 | 5.7 | 5.1 | 5.4 | 5.4 | 5.4 | 6.0 | 6.1 |

*Other additives: Refer to [0054] of this specification

**Shear rate was determined by a TBS viscometer at 150° C. under the conditions specified by ASTM D-4683 (the so-called HTHS150° C. viscosity), and also at 100° C.

It is demonstrated in EXAMPLES and COMPARATIVE EXAMPLES that the lubricating oil composition of the present invention has the following peculiar characteristics.

1) The lubricating oil composition, prepared in each of EXAMPLES 1 to 6 to contain a viscosity index improver having a peak area proportion of 5% or more at a chemical shift between 3.4 and 3.7 ppm in a $^1$H-NMR spectral pattern, can have a shear viscosity reduced to 5.1 to 5.7 mPa·s at 100° C. while keeping a shear viscosity of 2.6 mPa·s at 150° C. By contrast, the composition prepared in each of COMPARATIVE EXAMPLES 1 and 2 to contain a viscosity index improver having the peak area proportion below 5% shows a shear viscosity reduction limited to 6.0 to 6.1 mPa·s at 100° C. Thus, the effect of the composition of the present invention is clearly demonstrated.
2) Comparing the results of EXAMPLE 1 with those of EXAMPLE 4, it is found that a viscosity index improver having a higher weight-average molecular weight can bring the effect of the present invention more notably.
3) Comparing the results of EXAMPLE 4 with those of EXAMPLE 5, it is found that a viscosity index improver for the present invention can bring the effect of the present invention whether it is dispersed type or not.
4) Comparing the results of EXAMPLE 1 with those of EXAMPLE 6, it is found that the effect of the present invention by a viscosity index improver depends on aniline point of base oil; a higher aniline point brings the effect more notably with the same viscosity index improver.

As discussed above, it is found that the fuel-saving effect, measured under the conditions described above, by a polymethacrylate-based viscosity index improver greatly depends on the peak area proportion at a chemical shift between 3.4 and 3.7 ppm in a $^1$H-NMR spectral pattern, first of all. It is also found that the effect is more noted as improver weight-average molecular weight increases and also as base oil aniline point increases. These are peculiar phenomena which the inventors of the present invention have discovered.

The present invention provides a lubricating oil composition has a greatly reduced shear viscosity in an intermediate temperature range from 80 to 100° C. while keeping a viscosity at a given level under high temperature/high shear rate conditions, the effect being brought by a viscosity index improver having a specific $^1$H-NMR spectral characteristic. When used as an engine oil composition for vehicles and the like, it exhibits a notable fuel-saving effect and hence provides a very useful $CO_2$-related environment preservation measure.

Thus, the present invention can provide a lubricating oil for various areas including internal combustion engines to begin with, driving systems and other industrial areas.

What is claimed is:

1. A lubricating oil composition comprising a major amount of a base oil incorporated with 5.2 to 5.9 wt % of a dispersed type polymethacrylate-based viscosity index improver, wherein the base oil has an aniline point of about 107 to 116° C. or higher, and the polymethacrylate-based viscosity index improver has a weight-average molecular weight of about 460,000 and a peak area at a chemical shift between 3.4 and 3.7 ppm in a spectral pattern observed by nuclear magnetic resonance analysis ($^1$H-NMR) that accounts for about 10.5 to 12.6% of the total peak area, wherein shear viscosity at 100° C. of the lubricating oil composition is about 5.1 to 5.4 mPa·s or less and the shear viscosity at 150° C. is about 2.6 mPa·s, and wherein the base oil includes from 40 to 100 wt % hydrocracked mineral oil and from 0 to 60 wt % paraffinic mineral oil based on the total weight of the base oil used in the lubricating oil composition.

2. The lubricating oil composition according to claim 1, wherein the major amount of a base oil comprises from 80.6 to 81.4 wt % of the lubricating oil composition.

3. The lubricating oil composition according to claim 1, wherein the dispersed type polymethacrylate-based viscosity index improver is incorporated at about 5.8 to 5.9 wt %.

4. The lubricating oil composition according to claim 1 which is further incorporated with at least one species of another additive for lubricating oil.

5. The lubricating oil composition according to claim 4, wherein the additive for lubricating oil is of an organomolybdenum compound selected from the group consisting of molybdenum dithiocarbamate and molybdenum dithiophosphate.

6. The lubricating composition of claim 5 further comprising a polybutenyl succinic acidimide ashless dispersant and a zinc dithiophosphate.

7. The lubricating composition of claim 6 further comprising a calcium salicylate and a calcium sulfonate metal detergent.

8. The lubricating oil composition of claim 1 wherein the lubricant is a vehicle gear oil and the base oil and additives have favorable fuel-saving properties.

9. The lubricating oil composition of claim 1 wherein the lubricant is a vehicle gear oil and the base oil and additives have favorable bearing fatigue life characteristics.

10. The lubricating oil composition of claim 1 further comprising:

a molybdenum friction modifier of at least 0.01 and no more than 0.2 percent by mass as molybdenum of the lubricating composition;

an oxidation inhibitor at least 0.05 and no more than 5 percent by mass of the lubricating composition;

a metallic detergent at least 0.05 and no more than 5 percent by mass of the lubricating composition;

a phosphorous wear inhibitor comprising at least 0.02 and no more than 0.12 percent by mass as phosphorous of the lubricating composition;

a sulfur supplying agent comprising at least 0.02 and no more than 0.3 percent by mass as sulfur of the lubricating composition;

a corrosion inhibitor comprising at least 0.01 and no more than 3 percent by mass of the lubricating composition; and a pour point depressant comprising at least 0.01 and no more than 3 percent by mass of the lubricating composition.

11. The lubricating oil composition of claim 7 wherein the organomolybdenum compound comprises at least 0.01 and no more than 0.2 percent by mass as molybdenum of the lubricating composition, the polybutenyl succinic acidimide ashless dispersant comprises at least 0.05 and no more than 8 percent by mass of the lubricating composition, the zinc dithiophosphate comprises at least 0.02 and no more than 0.12 percent by mass as phosphorus of the lubricating composition, the calcium salicylate and calcium sulfonate metal detergents comprise at least 0.05 and no more than 5 percent by mass of the lubricating composition, and further comprising:

an oxidation inhibitor at least 0.05 and no more than 5 percent by mass of the lubricating composition;

a sulfur supplying agent comprising at least 0.02 and no more than 0.3 percent by mass as sulfur of the lubricating composition;

a corrosion inhibitor comprising at least 0.01 and no more than 3 percent by mass of the lubricating composition; and a pour point depressant comprising at least 0.01 and no more than 3 percent by mass of the lubricating composition.

12. A method of reducing the shear viscosity at 100° C. of a lubricating oil composition while maintaining about constant shear viscosity at 150° C. comprising:

providing a major amount of a base oil with an aniline point of about 107 to 116° C. or higher, and incorporating into the base oil 5.2 to 5.9 wt % of a dispersed type polymethacrylate-based viscosity index improver having a weight-average molecular weight of about 460,000 and a peak area at a chemical shift between 3.4 and 3.7 ppm in a spectral pattern observed by nuclear magnetic resonance analysis ($^1$H-NMR) that accounts for about 10.5 to 12.6% of the total peak area, wherein shear viscosity at 100° C. of the lubricating oil composition is about 5.1 to 5.4 mPa·s or less and the shear viscosity at 150° C. is about 2.6 mPa·s, and wherein the base oil includes from 40 to 100 wt % hydrocracked mineral oil and from 0 to 60 wt % paraffinic mineral oil based on the total weight of the base oil used in the lubricating oil composition.

13. The method of claim 12 wherein the major amount of a base oil comprises from 80.6 to 81.4 wt % of the lubricating oil composition.

14. The method of claim 12 wherein the dispersed type polymethacrylate-based viscosity index improver is incorporated at about 5.8 to 5.9 wt %.

* * * * *